United States Patent [19]

Ritchie et al.

[11] Patent Number: 4,948,529

[45] Date of Patent: Aug. 14, 1990

[54] STABLE HIGH RESISTANCE TRANSPARENT COATING

[75] Inventors: Ian T. Ritchie, Santa Monica; Wilfred C. Kittler, Westlake Village, both of Calif.

[73] Assignee: Andus Corporation, Canoga Park, Calif.

[21] Appl. No.: 213,448

[22] Filed: Jun. 28, 1988

Related U.S. Application Data

[60] Continuation of Ser. No. 46,808, May 4, 1987, abandoned, which is a division of Ser. No. 811,126, Dec. 18, 1985, Pat. No. 4,710,441.

[51] Int. Cl.[5] ..... H01B 1/06

[52] U.S. Cl. ..... 252/501.1; 252/512; 252/518; 252/513; 252/514; 204/192.1

[58] Field of Search ..... 430/62, 65, 69, 84; 369/288; 252/518, 512, 501.1; 427/35, 38; 204/192.1, 192.11

[56] References Cited

U.S. PATENT DOCUMENTS 4,194,994 3/1980 Baresel et al. ..... 252/518
4,250,228 2/1981 Fujioka .
4,409,134 10/1983 Yamazaki et al. ..... 252/518
4,816,183 3/1989 Bates ..... 252/501.1

FOREIGN PATENT DOCUMENTS 3639508 11/1985 Fed. Rep. of Germany .
2430629 7/1979 France .
2025915 1/1980 United Kingdom .

OTHER PUBLICATIONS

Thin Solid Films. vol. 102, No. 1, Apr. 1983, pp. 1–45, Elsevier Sequoia, Lausanne, CH; K. L. Chopra et al.: "Transparent Conductors–A Status Review".

*Primary Examiner*—Josephine Barr
*Attorney, Agent, or Firm*—Dennis E. Kovach; Herbert G. Burkard

[57] ABSTRACT

A stable high resistant transparent coating is formed by choosing an undoped wide band gap semiconducting oxide, and by forming a film from elements constituting the undoped oxide and from a dopant which is chosen so as to form a doped wide band gap semiconducting oxide, the doped oxide having an electrical resistance greater than the undoped oxide, the electrical resistance of the doped oxide being such that it equals an optimum value when the coating composition is inherently stable.

16 Claims, 6 Drawing Sheets

STABLE HIGH RESISTANCE TRANSPARENT COATING

This application is a continuation of application Ser. No. 046,808, filed May 4, 1987, now abandoned, which is a division of application Ser. No. 811,126, filed Dec. 18, 1985, now U.S. Pat. No. 4,710,441.

BACKGROUND OF THE INVENTION

The present invention relates to high resistance transparent coatings, and specifically methods for formulating such coatings so as to increase an electrical resistance thereof, and useful articles including such increased resistance coatings.

High resistance transparent coatings have numerous applications. For example, when copying images using electrostatic imaging, it is common to subject a film having a dielectric material on a surface thereof to an electrical potential so as to selectively dispose electrostatic charge thereon which is then developed by applying a toner onto the surface of the film.

The film itself comprises the dielectric material layered over a high resistance transparent coating which is laid over a substrate, such as polyester. In this case, the high resistance transparent coating functions as a ground plane and is therefore required to have an electrical resistance within a predetermined range such that the coating can function as required.

Specifically, if the electrical resistance of the ground plane coating is too low, say for example below 100,000 ohms per square, the ground plane coating is unduly conductive which results in ghost images being formed by electrodes in close proximity to other electrodes which create an electrical potential for depositing an electric charge on the dielectric. Alternatively, if the electrical resistance of the ground plane coating is unduly large, the time constant for deposition of charge on the film becomes too long resulting in very slow image formation, typical excessively high resistances being those above 20 meg ohms per square.

Furthermore, even though a range of electrical resistances for the ground plane coating exists for an electrostatic imaging process to work, oftentimes there are optimum resistance values which are desired to optimally create electrostatic images, depending on the exact type of electrostatic imaging process being used. A disadvantage in the art is that material compositions which yield a particularly desired optimum electrical resistance are generally unstable. Specifically, small variations in the material composition during manufacture tend to unduly vary the electrical resistance. Thereafter, in use changes induced in the composition due to environmental effects, such as oxidation migration for example, further change the electrical resistance.

SUMMARY OF THE INVENTION

Accordingly, it is one object of the present invention to eliminate the above-noted drawbacks, and to provide an improved coating which is highly stable and which also can be formulated so to have any one of many desired electrical resistances and good optical transparency, especially at visible light wavelengths, so as to be suitable as a ground plane coating for electrostatic imaging processes.

This and other objects of the invention are achieved by a coating which comprises a partially transparent conductive coating which includes a wide band gap semiconducting oxide which is doped with an appropriate material so as to vary the electrical resistance of the oxide significantly from that otherwise obtainable from an undoped identical oxide. Specifically, the dopant chosen interacts electronically with the metal oxide to increase its electrical resistance.

DESCRIPTION OF THE PREFERRED EMBODIMENTS

According to one embodiment of the invention, a film containing a wide band gap semiconducting coating is formed as a ground plane for electrostatic recording. A preferred embodiment is to utilize tin oxide.

Figure 1:
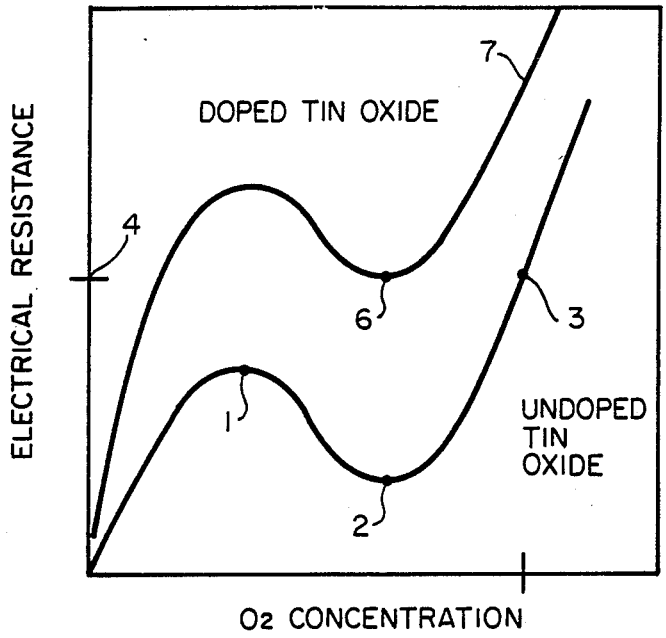
FIG. 1 is a graph which generally illustrates how an electrical resistance of an undoped and optimally doped tin oxide film varies with an oxygen concentration thereof.

FIG. 1 illustrates a typical graph for a coating of tin oxide showing how its electrical resistance varies as a function of an oxygen concentration of the tin oxide. As is evident from studying the undoped tin oxide curve, the electrical resistance of an undoped tin oxide coating initially goes up with its oxygen concentration, until it reaches a peak identified by reference numeral 1, and thereafter the electrical resistance of the undoped coating goes down with a further increase in the oxygen concentration until it reaches a minimum value at reference numeral 2, and thereafter the electrical resistance of the coating rises with further increases in the oxygen concentration. Only coatings with oxygen concentrations greater than about that of the coating 1 are highly transparent.

As is evident from examining FIG. 1, for material stability purposes, it is preferred to produce undoped tin oxide coatings having oxygen concentrations close to that for achieving the operating point 2 since variations in manufacturing composition are minimal at this point and since migration of oxygen into and out of the coating over time will have a minimum effect on the electrical resistance of the coating at this operating point. Hence the coating will be inherently stable in manufacture as well as in use.

However, since the operating point 2 results in an electrical resistance of about 2 kohm per square for coatings about 500 angstroms thick, this particular electrical resistance is not optimum for the end use of the coating desired. In addition, though an operating point such as that identified by reference numeral 3 may achieve a predetermined electrical resistance 4, the electrical resistance 4 of the undoped tin oxide coating at this point is highly unstable. Specifically, if during manufacture a small variation in the oxygen concentration occurs, a magnified change in the resistance occurs. Furthermore, in use, oxygen migration within the coating further changes the electrical resistance. Therefore, product reliability is relatively low. A coating from the undoped tin oxide material may be manufactured with a higher resistance by making the coating thinner, but this method cannot increase the resistance by a factor of more than about 5 as thin coatings, especially coatings thinner than 100 angstroms, are mechanically and environmentally unstable.

According to one preferred embodiment of the invention illustrated by curve 7 in FIG. 1, the tin oxide is doped during its formation with a metal, for example copper or aluminum, by a specified amount so as to increase an electrical resistivity of the tin oxide in amounts sufficient such that its intermediate minimum electrical resistance point 6 results in the coating having the desired electrical resistance 4. Hence, the coating not only has the optimum electrical resistance, it furthermore has optimum stability since small changes in the oxygen concentration of the coating which result either during its manufacture or subsequent thereto due to environmental conditions which may induce chemical alterations of the coating result in minimum changes of the electrical resistance of the coating.

Preferably, for stability purposes, the oxygen concentration chosen is optimized such that the electrical resistance of the doped coating corresponds to the intermediate minimum electrical resistance for the doped coating. The actual oxygen concentration used can be ±2% different from the optimum concentration, and even ±5% different, though as the difference gets larger, the stability worsens.

Though copper or aluminum are both preferred dopants, other materials will work as well so long as the other material has an odd number of electrons more or less than the tin, such other materials being indium, gallium, boron, thallium, silver and gold; and in addition, nickel, palladium, platinum, zinc, cadmium, mercury and vanadium can also be used, if desired. Additions of dopants may decrease the visible light transmittance of the coatings, and different dopants may affect the visible light transmittance differently. For example, a tin oxide coating doped with aluminum and which has a resistivity of 1 mega ohm per square at operating point 6 may have a higher visible light transmittance than a tin oxide coating doped with copper to have a resistivity of 1 mega ohm per square at operating point 6. Of course, other consideratons could lead one to chose a dopant with decreased visible light transmittance, such as ease of manufacture. For example, for tin oxide, though copper does slightly reduce the doped coating visible light transmittance, copper has other advantages over aluminum for doping tin oxide such as ease of sputtering.

Furthermore, though tin oxide is referred to as one preferred embodiment for which the invention is suitable, other oxides can also be used within the scope of the invention, and in particular any oxide which comprises a wide band gap semiconducting oxide. Suitable metals for forming such oxides include indium, zinc, cadmium and lead for example. Again, for any metal chosen so as to produce a wide gap semiconducting oxide, the metal chosen to dope the oxide so as to increase its electrical resistivity in amounts sufficient such that the operating point 6 is optimally stable is any metal which has an odd number of electrons more or less than that metal which forms the semiconducting oxide. Other elements with different electronic shell configurations may also be chosen.

The invention will now be described with reference to a few particular examples.

EXAMPLE 1

A series of coatings was made on PET polyester film by reactive sputter deposition of composite tin/copper targets in atmospheres containing various partial pressures of oxygen gas.

The ratio of tin to copper was varied systematically, as was the partial pressure of oxygen in the reactive sputtering discharge, to obtain a series of coatings with different tin, copper, and oxygen concentrations. The properties of these coatings were then measured and the coatings were then subjected to accelerated aging to determine their environmental stabilities.

A four inch diameter planar magnetron source, and a substrate holder suitable for holding substrates of PET polyester film, three inches square, were located inside an 18" diameter bell jar, evacuated by a standard oil diffusion pumping system. A movable shutter was placed between the magnetron source and the substrate. Composite tin/copper sputtering targets were fabricated by placing pie-shaped copper segments on a 4" diameter tin disc. Targets were fabricated with 4, 8, 14 and 17% surface coverage by copper, respectively. For each composition, a series of coatings was made at various oxygen partial pressures.

The coating conditions were as follows:
target to substrate distance, 3 ¼";
sputtering power, 51 W;
voltage, 405 V
current 0.082 amps;
argon partial pressure, 6.0 mTorr;
sputtering time, 120 sec.

Figure 3:
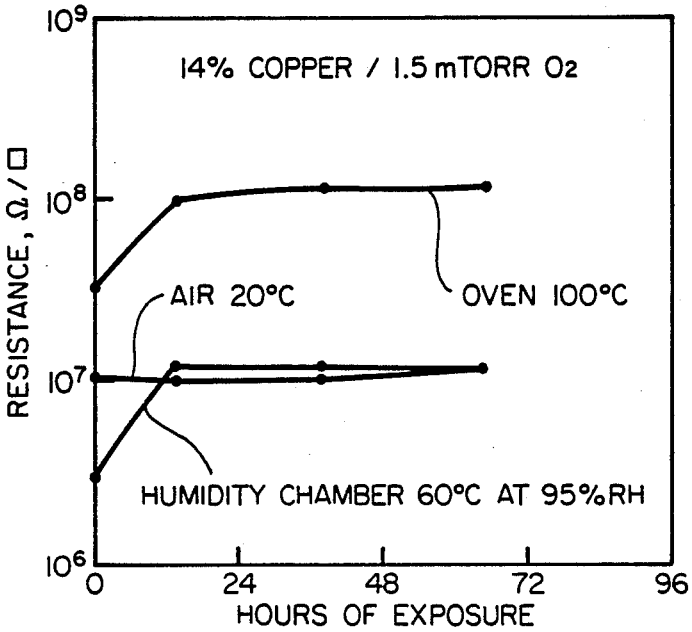
FIG. 3 is a graph illustrating the relative stability of the coating shown in FIG. 2 having an oxygen concentration which corresponds to the minimum interim electrical resistivity, FIG. 3 illustrating two environmental test conditions.
Figure 2:
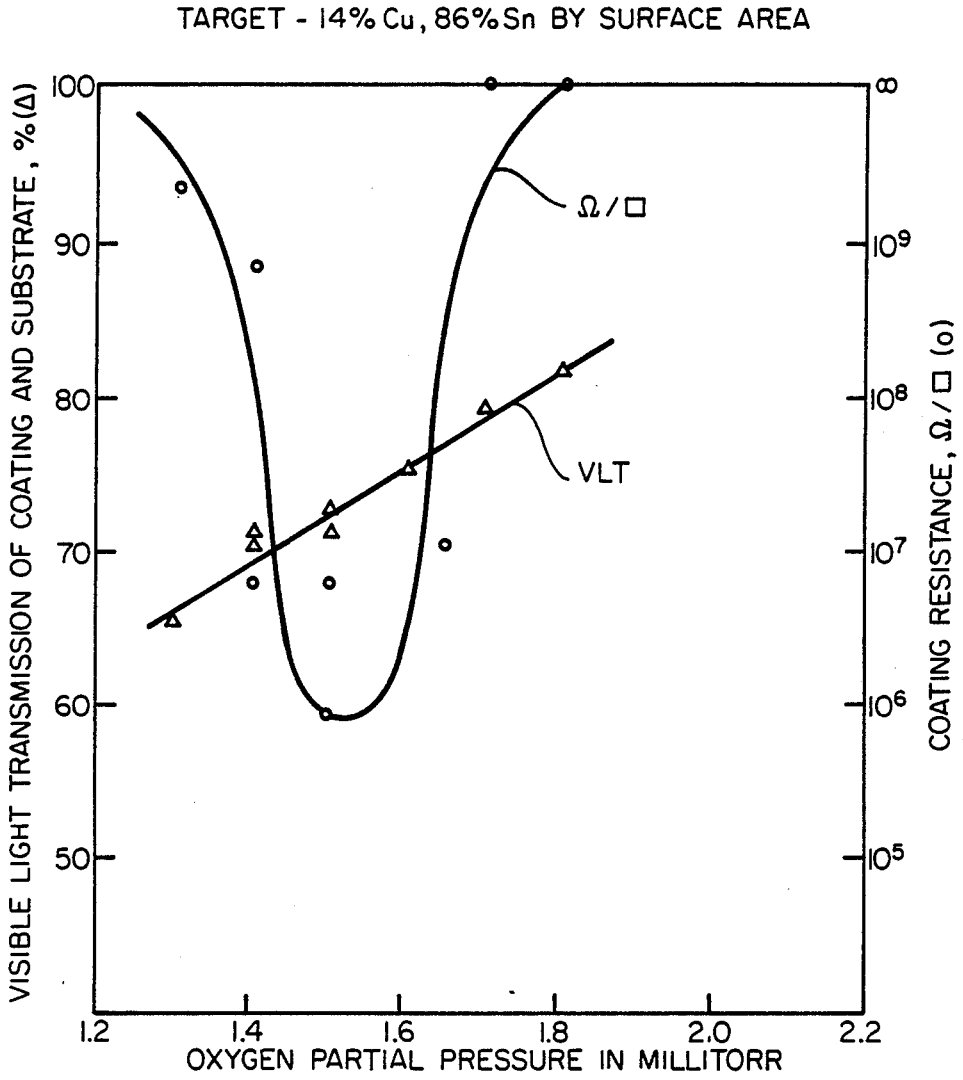
FIG. 2 is an actual graph showing how the electrical resistance and a light transmittance of a suitably doped tin oxide film vary as a function of its oxygen concentration.

The oxygen partial pressure range varied for each target composition, but by way of example, a range of 1.3 to 1.8 mTorr was used to sputter the target with 14% copper coverage of the tin. A thickness of the coatings produced was maintained relatively constant at about 400 angstroms. A graph of the electrical resistances of the coatings and of their visible light transmittances as a function of oxygen partial pressure is illustrated in FIG. 2 for the 14% copper percent coverage. The coating produced with an oxygen partial pressure of 1.5 mTorr was found to have the lowest stable electrical resistance of these coatings. FIG. 3 shows that this coating exhibits remarkable environmental stability in air, 100° C. dry heat, and 60° C. 95% relative humidity.

Figure 4:
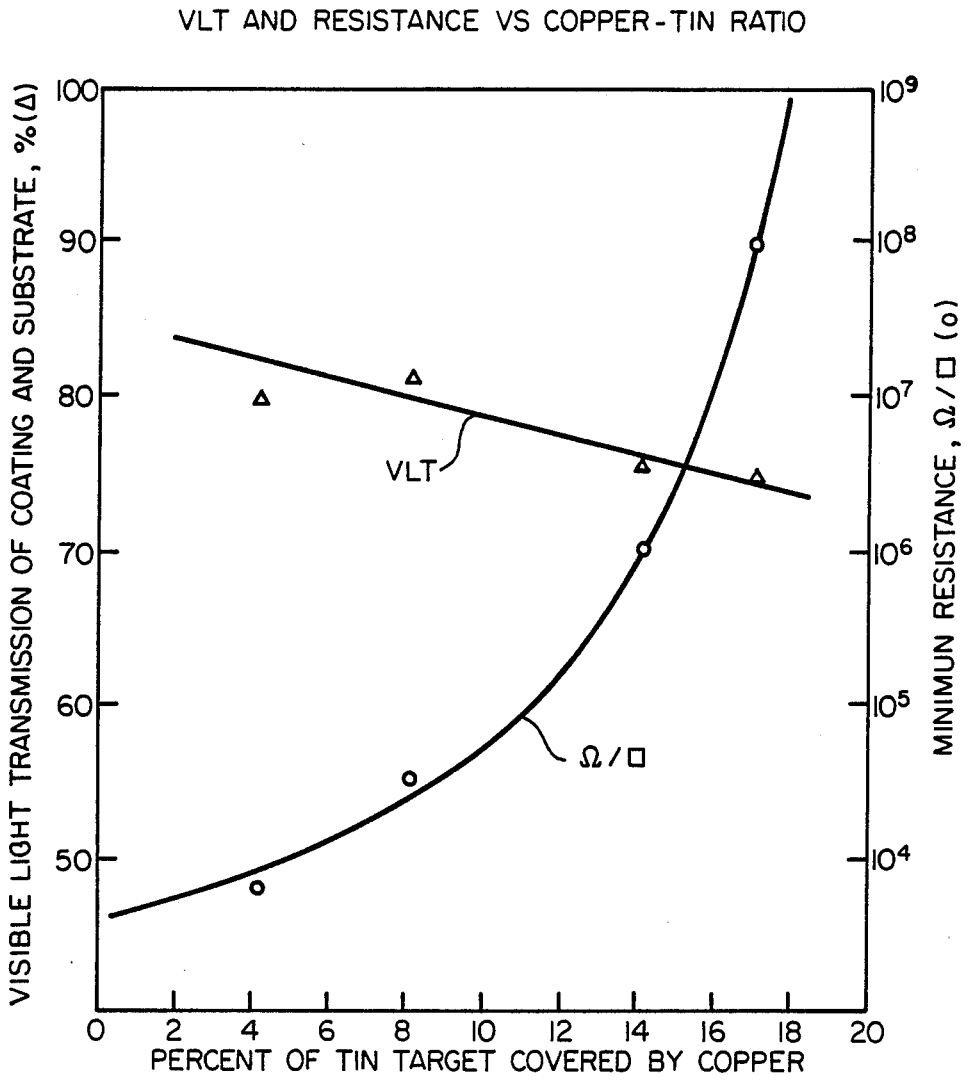
FIG. 4 shows an electrical resistance and visible light transmission of the most stable coatings produced with 4, 8, 14, and 17% surface coverages respectively of a copper dopant on a composite target.

This procedure was repeated for the other composite targets mentioned above while maintaining a thickness of the coating relatively constant, and FIG. 4 shows the electrical resistance and visible light transmission of the most stable coating produced with each composite target. In each case this most stable coating was found to be that with the minimum electrical resistance, e.g., an oxygen concentration at or close to the operating point 6 in FIG. 1. The curve of FIG. 4 allows one to predict the surface target coverage which will be necessary to produce a stable transparent coating with a desired electrical resistance.

By way of comparison, a series of undoped tin oxide coatings was produced so as to have a thickness approximately the same as the doped coatings, and the most stable coating (e.g. at operating point 2) had an electrical resistance of about 2 kohm per square.

Accordingly, the invention is capable of yielding coatings having minimum most stable electrical resistances orders of magnitude greater than similarly constructed undoped coatings, FIGS. 2 and 4 showing increases of at least 1, 2, 3, 4, 5, and 6 orders of magnitude and more.

EXAMPLE 2

A second series of experiments was performed using the same apparatus and general procedures used in Example 1, with the exception that the composite sputtering target was made by placing pie-shaped segments of aluminum, rather than copper, on a tin target. Targets were fabricated with 23, 35, 42, 50, 60, and 70% aluminum coverage, respectively. The coating conditions were as follows:

source-substrate distance 3 ¼";
sputtering power, 175 W;
voltage, 244 V;
current, 0.67 amps;
argon partial pressure, 5.0 mTorr;
coating time, 45 sec.

Figure 5:
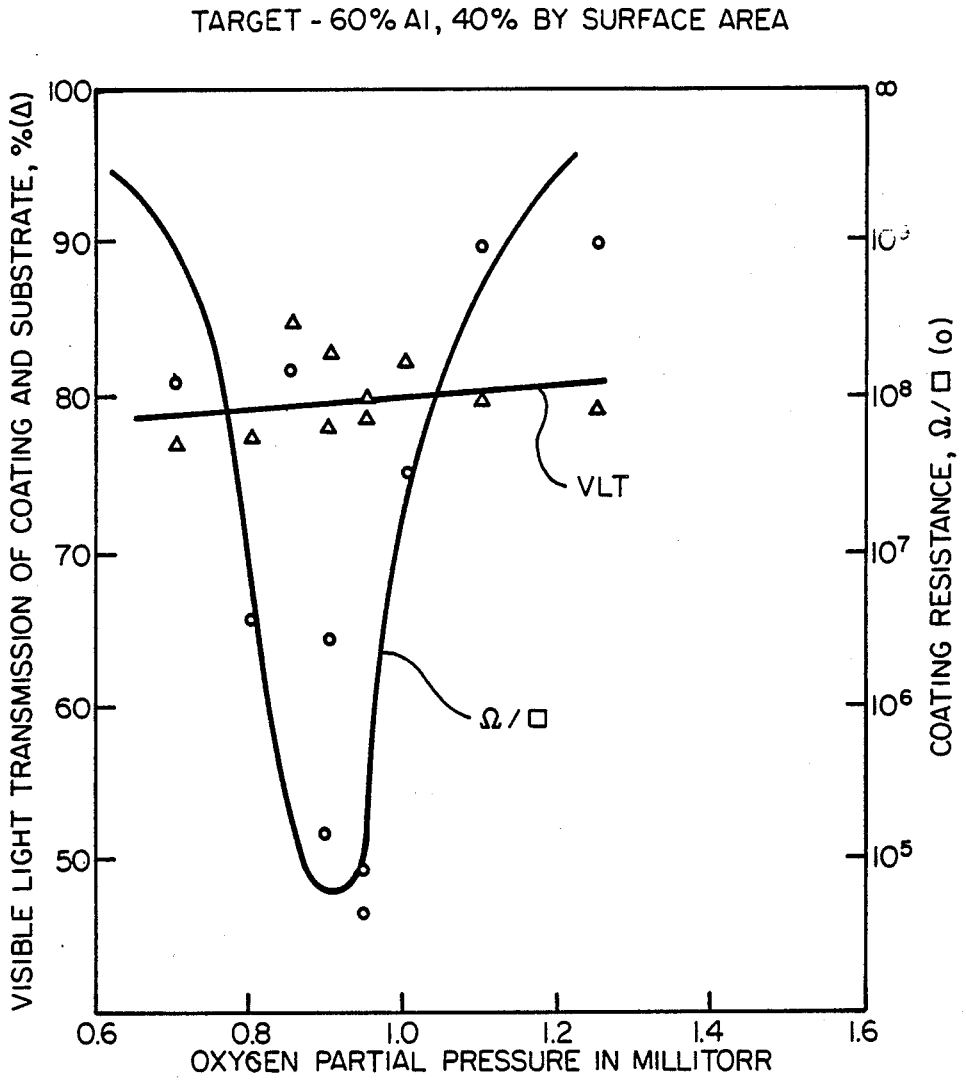
FIG. 5 illustrates an electrical resistance and visible transmission of a 60% aluminum - 40% tin composite target as a function of variations in oxygen concentration.
Figure 6:
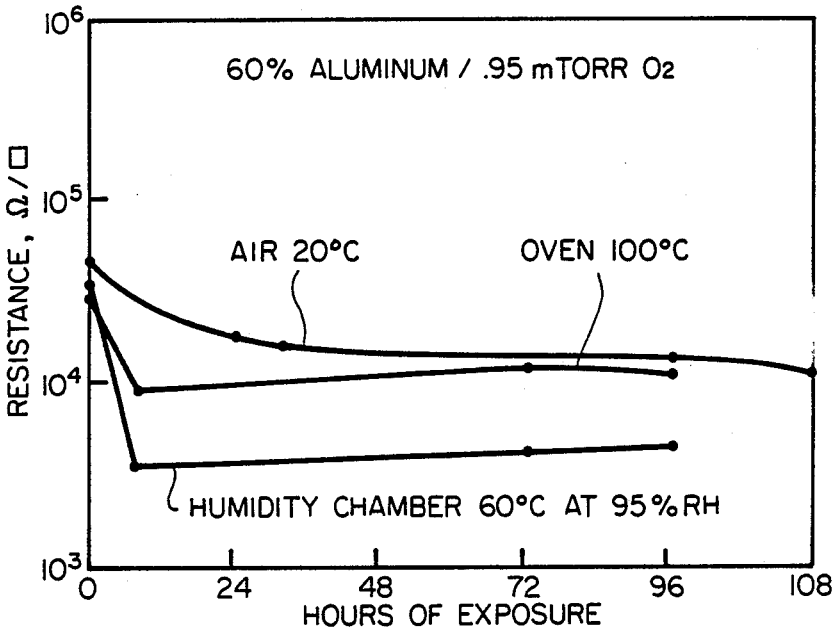
FIG. 6 illustrates the environmental stability of the most stable coating illustrated in FIG. 5, e.g. that coating which has the minimum interim electrical resistance.
Figure 7:
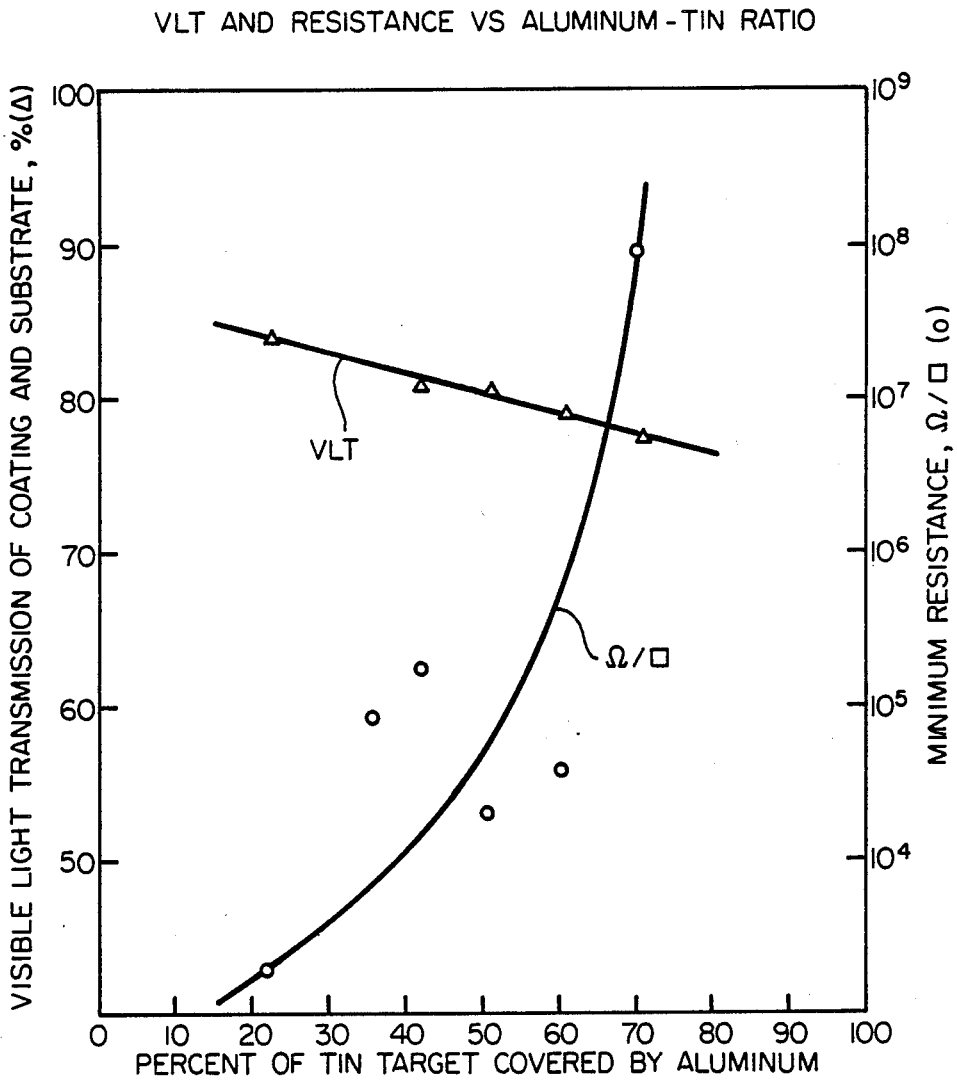
FIG. 7 illustrates the electrical resistance and visible light transmission of the most stable coatings formed from composite aluminum-tin targets having aluminum coverage of 23, 35, 42, 50, 60 and 70%, respectively.

The oxygen partial pressure was varied for each target composition. By way of example, the oxygen partial pressure was varied from 0.7 to 1.25 mTorr for a 60% aluminum on tin target. FIG. 5 shows the behavior of the electrical resistance and the visible light transmittance as a function of oxygen partial pressure for 60% aluminum target coverage. At a partial oxygen pressure of 0.95 mTorr the coating was most stable and its environmental stability is demonstrated by the data presented in FIG. 6. This procedure was repeated for each of the tin-aluminum target coverage conditions given above, and the data presented in FIG. 7 shows the electrical resistance and visible light transmittance of the most stable coating produced at each target coverage level. In all cases, the most stable coating was found to be that with the minimum electrical resistance. This curve allows the target coverage level to be predicted which will produce a stable transparent coating with a desired electrical resistance.

As Examples 1 and 2 and FIGS. 2–7 indicate, once a particular electrical resistance of a wide band gap semiconducting oxide is chosen, the examples all being directed to tin oxide, in accordance with the teachings of the present invention suitable metal dopants can be added to the oxide in its formation so as to precisely control the operating point 6 and its electrical resistance so that the electrical resistance at the operating point 6 of FIG. 1 can be made to correspond with the desired electrical resistance whereat the coating is most stable.

It should be noted that electrical resistance varies with thickness, and accordingly the invention allows optimal thickness to be achieved as well. Preferred embodiments of the invention include coatings having a thickness between 100–2000 angstroms, more preferably between 200–1000 angstroms, and most preferably between 300–600 angstroms.

Though the invention has been described by use of particular examples directed to tin oxide, it is readily apparent that other oxides such as indium, zinc, cadmium, lead, etc. are also suitable to be used with the present invention.

Figure 8:
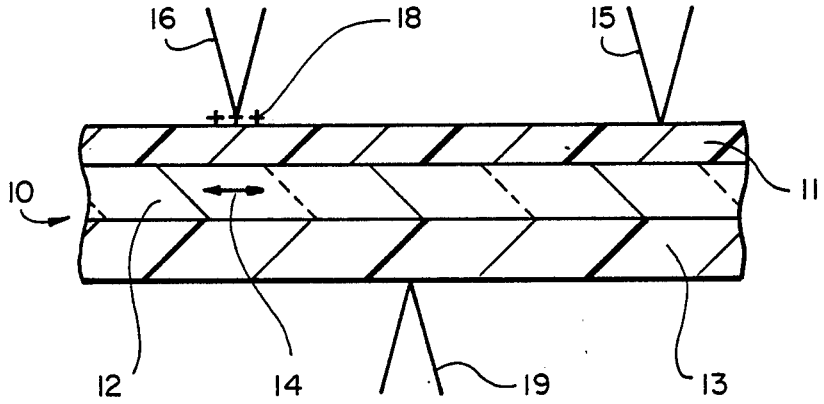
FIG. 8 illustrates an electrostatic imaging film which includes embodiments of the invention.

A preferred use of the invention is for the production of a film to be used for electrostatic imaging, as illustrated in FIG. 8 whereat the film 10 includes a dielectric layer 11 disposed over a partially transparent high resistance coating 12 made in accordance with the present invention, which is disposed over a substrate 13, such as plastic. As described previously, the coating 12 must have an electrical resistance which is sufficiently high such that its electrical conductivity in the direction of arrows 14 is not so large so as to conduct current to electrode 15 remote from an electrode 16 used to generate an electric field to deposit a charge 18 on a surface of the dielectric layer 11. Hence, an electrical resistance of the coating 12 must be relatively high. However, if the electrical resistance of the coating 12 is unduly high, then the time constant for deposition of electrostatic charge 18 on the dielectric layer 11 becomes too long when an electric field of desired magnitude is generated by electrode 16 in combination with an electrode 19, and hence the writing or formation of the image is impractically slow. Accordingly, as is understood in the art, the coating 12 must have an electrical resistance which is not too large and also which is not too low. In accordance with the invention, according to the particular electrode setup and particular electrostatic imaging process being used therewith, optimum values of the electrical resistance of the coating 12 can be determined, and subsequently utilizing the teachings of the present invention of doping the coating 12 as it is formulated, it is a straightforward procedure to produce a coating 12 having a desired thickness and the desired electrical resistance which also corresponds to a minimum electrical resistance within a range of oxygen concentrations of the particular oxide being used.

Though the invention has been described with reference to certain preferred embodiments thereof, it should readily be understood that the invention is not to be limited thereby, and is to be limited only by the appended claims.

What is claimed is:

1. A method of forming a partially transparent conductive coating, comprising the steps of:

choosing an undoped wide band gap semiconducting oxide;

forming a film from elements constituting the undoped oxide and from a dopant so as to form a doped wide band gap semiconducting oxide, the doped oxide having an electrical resistance greater than the undoped oxide, the doped oxide being one whose electrical resistance first reaches an interim maximum and then reaches an interim minimum as an oxygen concentration thereof is varied and increased, the oxygen concentration of the doped oxide being within ±5% of an oxygen concentration yielding the interim minimum electrical resistance of the doped oxide.

2. The method of claim 1, the film consisting essentially of the elements and the dopant.

3. The method of claim 1, the doped oxide having an electrical resistance more than an order of magnitude greater than the undoped oxide.

4. The method of claim 1, the doped oxide having an electrical resistance more than two orders of magnitude greater than the undoped oxide.

5. The method of claim 1, the doped oxide having an electrical resistance more than three orders of magnitude greater than the undoped oxide.

6. The method of claim 1, the wide band gap semiconducting oxide including a first metal, a dopant used for doping comprising a second metal, the second metal having an odd number of electrons different than the first metal.

7. The method of claim 1, the doped oxide oxygen concentration being within ±2% of the oxygen concentration yielding the interim minimum electrical resistance.

8. The method of claim 1, the doped oxide being produced by sputtering a two metal composite or alloy target in a partial atmosphere of oxygen.

9. The method of claim 6, the first metal being selected from the group consisting of tin, indium, zinc, lead, and cadmium.

10. The method of claim 9, the first metal consisting of tin.

11. The method of claim 9, the second metal being copper or aluminum.

12. The method of claim 10, the second metal being copper or aluminum.

13. The method of claim 9, the second metal being selected from the group consisting of copper, aluminum, indium, gallium, boron, thallium, silver, gold, nickel, palladium, platinum, zinc, cadmium, mercury, and vanadium.

14. A high resistance partially transparent conductive coating, comprising:

a wide band gap semiconducting oxide, an undoped composition thereof having a first electrical resistance, the oxide being doped so as to form a doped wide band gap semiconducting oxide whose electrical resistance is increased by an amount greater than an order of magnitude over the undoped composition, the doped oxide being one whose electrical resistance first reaches an interim maximum and then reaches an interim minimum as its oxygen concentration is increased, an oxygen concentration of the doped oxide being within ±5% of an oxygen concentration yielding the interim minimum electrical resistance.

15. The coating of claim 14, the doped oxide being at least 70% transparent to visible light.

16. The coating of claim 14, a metal forming the oxide being chosen from the group consisting of tin, indium, zinc, cadmium and lead, a dopant used for doping the wide band gap semiconducting oxide being a metal chosen from the group consisting of copper, aluminum, indium, gallium, boron, thallium, silver, gold, nickel, palladium, platinum, zinc, cadmium, mercury, and vanadium.

* * * * *